United States Patent [19]

Chatten

[11] 4,372,688

[45] Feb. 8, 1983

[54] LIQUID OPERATED CLOCK

[76] Inventor: Victor H. Chatten, 1567 W. 215th St., Torrance, Calif. 90501

[21] Appl. No.: 351,326

[22] Filed: Feb. 22, 1982

Related U.S. Application Data

[63] Continuation-in-part of Ser. No. 343,414, Jan. 28, 1982.

[51] Int. Cl.[3] ..... G04B 1/26

[52] U.S. Cl. ..... 368/65; 368/93

[58] Field of Search ..... 368/65, 93

[56] References Cited

U.S. PATENT DOCUMENTS

| | | | |
|---|---|---|---|
| 1,544,652 | 7/1925 | Knutson | 368/93 |
| 2,375,568 | 5/1945 | McAuliffe | 368/93 |
| 3,520,125 | 7/1970 | Kuhn | 368/65 |
| 3,831,371 | 8/1974 | Vatterott | 368/65 |
| 3,871,167 | 3/1975 | Afshar | 368/65 |
| 4,028,877 | 6/1977 | Vatterott | 368/65 |

FOREIGN PATENT DOCUMENTS

| | | | |
|---|---|---|---|
| 553471 | 12/1956 | Italy | 368/65 |

*Primary Examiner*—Ulysses Weldon

*Attorney, Agent, or Firm*—Lyon & Lyon

[57] ABSTRACT

A liquid operated clock employs buckets pivoted to arms of a carrier rotating at constant speed. The buckets are sequentially moved below the surface of a liquid reservoir to fill the buckets, elevate them and cause them to discharge into a receiver. After a predetermined number of buckets of liquid have accumulated within the receiver, it is suddenly drained by a siphon tube back into the liquid reservoir. The change in weight of the receiver between full and empty conditions operates through a ratchet mechanism to drive the input shaft of a clock mechanism in an intermittent fashion. Cam and follower means control filling and dumping of the buckets.

6 Claims, 8 Drawing Figures

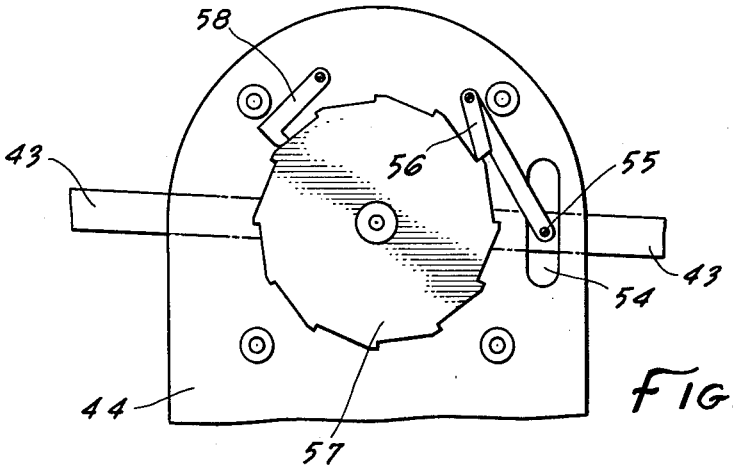
FIG. 3
FIG. 4
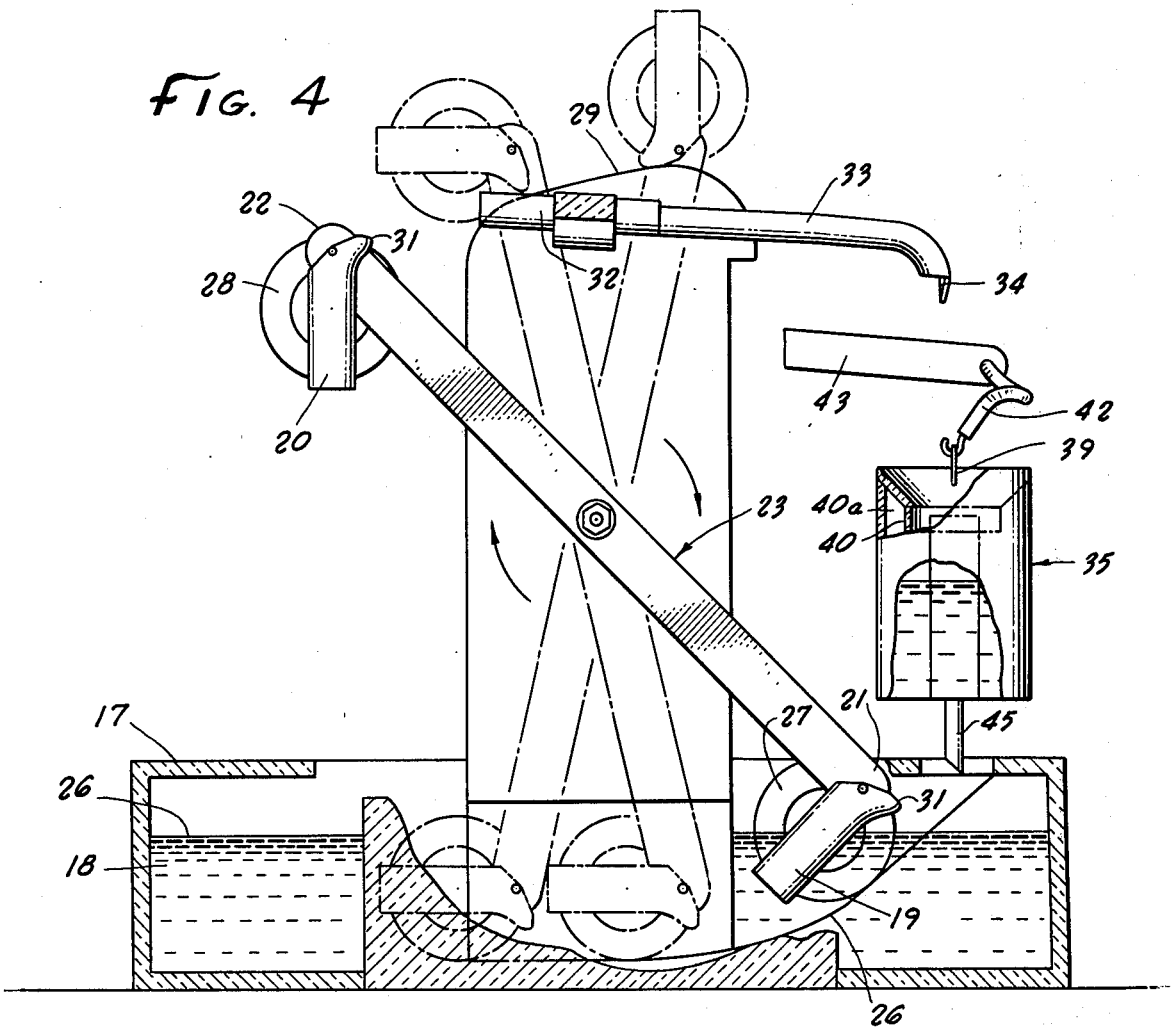

LIQUID OPERATED CLOCK

This application is a continuation-in-part of my prior application Ser. No. 343,414 filed Jan. 28, 1982.

This invention relates to liquid operated clocks and is particularly directed to improvements which give the device a unique appearance and unique manner of operation which is pleasing both to the eye and to the ear.

Small buckets each pivotally mounted on an arm of a constantly rotating carrier pick up liquid such as water from an open top reservoir, lift it through an arc, and discharge it into a stationary receptacle at a higher elevation. Each bucketful of liquid gravitates from the receptacle, then falls through open air into a receiver which is open at the top. After the receiver has accumulated a predetermined number of buckets of liquid, it suddenly discharges substantially its entire liquid contents back into the open top reservoir. The cyclical change of weight of the receiver is utilized to control intermittent movement of the hands of a clock. The sight and sound of the filling of the buckets, the discharge into the elevated receptacle, the gravity feed to a discharge location, the free fall of liquid into the receptacle, and the intermittent discharge of the liquid from the receptacle all provide a pleasing movement of the liquid in the various stages.

Other and more detailed objects and advantages will appear hereinafter.

In the drawings:

FIG. 3 is a sectional detail taken substantially on the lines 3—3 as shown on FIG. 2.

FIG. 4 is a sectional elevation taken substantially on the lines 4—4 as shown on FIG. 2.

Figure 1:
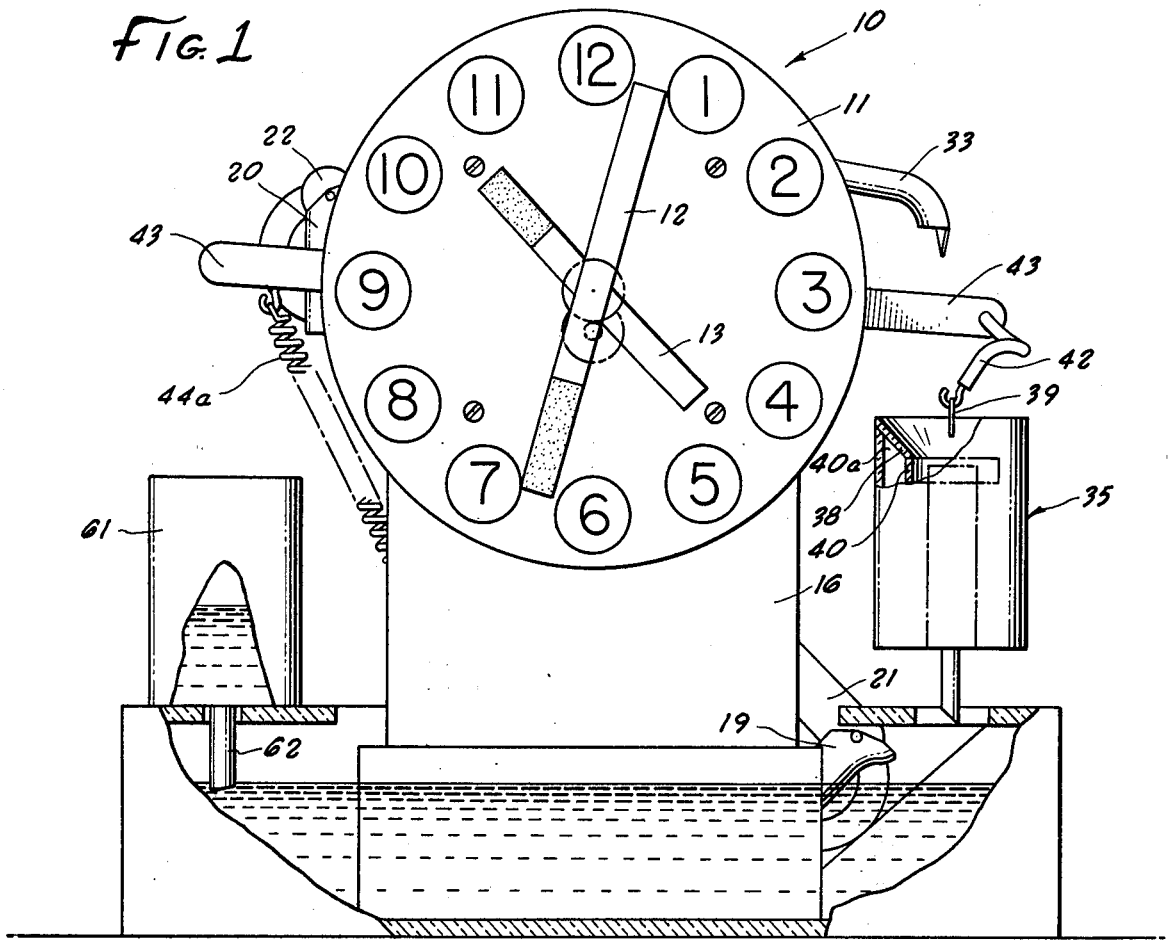
FIG. 1 is a front elevation partly broken away, showing a preferred embodiment of this invention.
Figure 2:
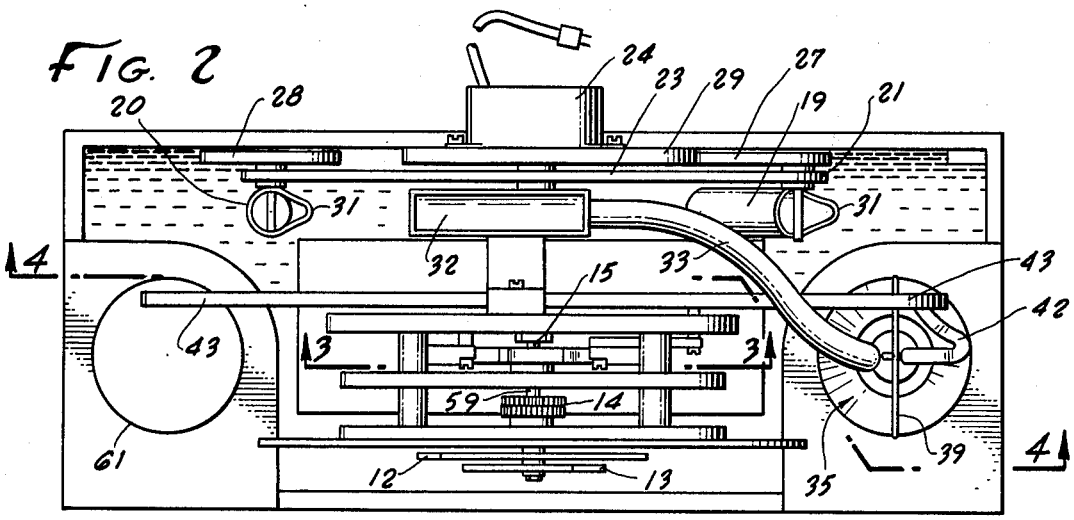
FIG. 2 is a top plan view.

Referring to the drawings, the clock mechanism generally designated 10 includes a stationary clock face 11 and the usual movable hands 12 and 13. The clock mechanism includes gearing 14 driven by an input shaft 15. The clock mechanism is mounted on the stationary support wall 16 which is fixed with respect to the base 17.

The base 17 has walls which define a liquid reservoir 18 which is open at the top. Buckets 19, 20 are each pivotally mounted at one end of an arm 21, 22, the arms constituting a rotary carrier 23. This rotary carrier is supported and driven from an electric clock motor 24 turning at constant speed.

A stationary cam track 26 is positioned in the reservoir 18 mostly below the liquid level 26. Cam followers 27, 28 are fixed with respect to the buckets 19 and 20. These cam followers cooperate with the cam track 26 to insure proper orientation of the buckets as they pass through the reservoir 18 below the liquid level 26. As each liquid filled bucket rises from the reservoir 18, it is suspended in the position shown by bucket 20 in FIG. 4, the upper end of the bucket being open and the lower end closed. The position of each bucket with respect to its respective arm changes as the arm moves through its path of travel, and the relative positions of the bucket and the arm in the course of this movement are shown in phantom lines in FIG. 4.

The upper cam track 29, also stationary, is also contacted by the cam followers 27 and 28 to cause the buckets 19 and 20 to tilt into discharge position. Liquid flows from each bucket over its discharge lip 31 and into a stationary open top receptacle 32. From the receptacle, the liquid flows through the delivery tube 33 by gravity and is discharged at its downstream end 34.

Figure 5:
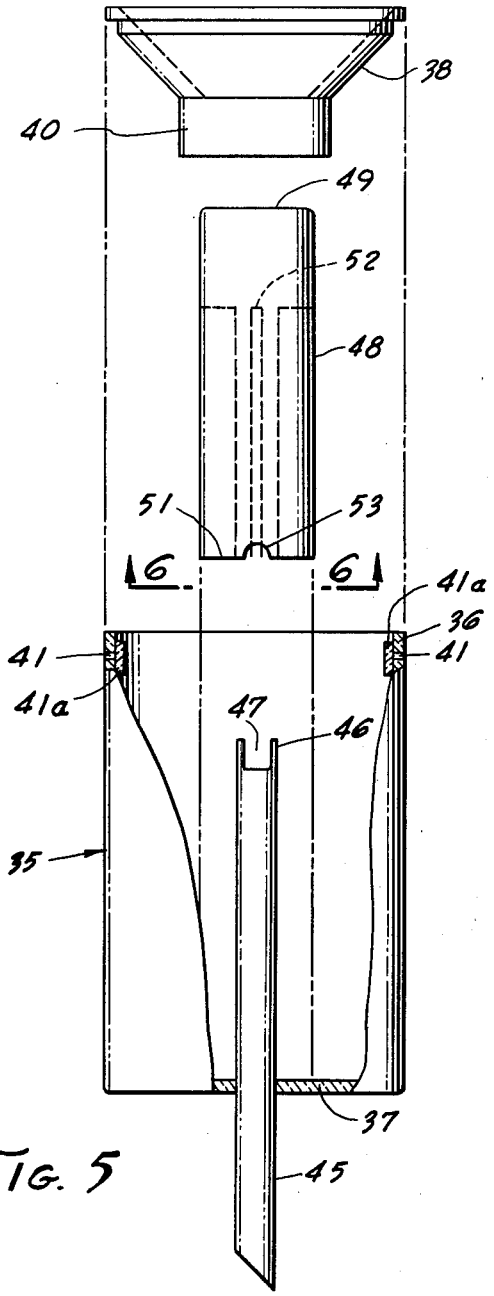
FIG. 5 is an exploded view showing parts of the liquid receptacle.
Figure 6:
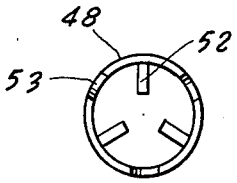
FIG. 6 is a sectional detail taken substantially on the lines 6—6 as shown on FIG. 5.
Figure 7:
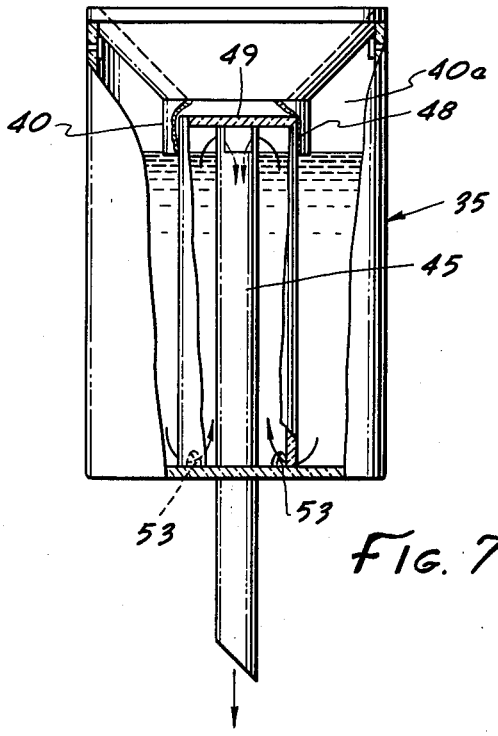
FIG. 7 is a front elevation of the receptacle illustrating the siphon discharge feature.

A receiver 35 is suspended in a position directly below the downstream end 34 to receive the liquid discharged therefrom. As best shown in FIG. 5, the receiver 35 has a cylindrical side wall 36, a closed bottom wall 37, and an open funnel shaped cover 38 constituting the top wall. A metal bail 39 is received in lateral openings 41 near the top of the side wall 36, and this bail 39 is carried on a hook 42 fixed to one end of the pivoted member 43. The openings are sealed off from the interior by internal shields **41*a*. The skirt 40 defines a closed air space 40*a* within the receptacle 32 and the cover 38. The member 43 is pivotally mounted on the stationary support 44. A tension spring 44*a* acts to urge the pivoted member 43 to move in a counterclockwise direction, as viewed in FIG. 1, and thus serves to counterbalance the weight of the receiver 35** and its liquid contents.

The siphon tube 45 is positioned centrally of the wall 36 of the receiver 35 and is fixed to and extends through the bottom wall 37. This siphon tube 45 is open at both ends, the upper end 46 having a notch 47. A control cylinder 48 closed at its upper end 49 and open at its lower end 51 is provided with internal fins 52 which slide over the siphon tube 45. The control cylinder 48 may rest on the bottom wall 37 of the receiver 35 or it may rest on the upper end 46 of the siphon tube 45. A bucketful of liquid is received at regular time intervals through the sloping sides of the funnel-like cover 38 and this liquid accumulates within the cylinder wall 36 above the lower wall 37, but not above the lower end of the skirt 40. The liquid also passes into the interior of the control cylinder 48 through notches 53 in the lower end thereof. As the receiver 35 fills with liquid as it is delivered intermittently from the delivery tube 33, the liquid level rises within the cylindrical wall 36 as well as within the interior of the control cylinder 48. No liquid escapes during this filling period. However, when the receiver 35 has received the last of a predetermined number of buckets of liquid, the liquid level within the receiver 35 rises above the level of the notch 47 in the upper end of the siphon tube 45, slightly compressing the air in the closed space **40*a* which assists in starting siphoning. Substantially all of the liquid within the receiver 35 then moves suddenly by siphon action through the control cylinder 48 and down through the siphon tube 45 even through the space 40*a*** is then open to atmosphere.

The rapid discharge of liquid from the receiver 35 into the reservoir 18 suddenly decreases the weight of the receiver 35 and consequently the tension spring **44*a* acts to move the pivoted member 43 in a counterclockwise direction, as viewed in FIGS. 1 and 3**.

A slot 54 in the stationary support 44 provides clearance for travel of a pin 55 projecting laterally from the pivoted member 43. Movement of the pin 55 operates the ratchet pawl 56. The ratchet wheel 57 is operated intermittently by the pawl 56 to produce clockwise motion of the ratchet wheel 57, as viewed in FIG. 3. The pawl 58 also cooperates with the ratchet wheel 57 to prevent retrograde movement thereof. The ratchet wheel 57 and its shaft 59 turn the gearing 14 of the clock mechanism 10. It will be understood that each time the receiver 35 empties its liquid contents, the input shaft 15 of the clock mechanism 10 is turned a predetermined degree.

Figure 8:
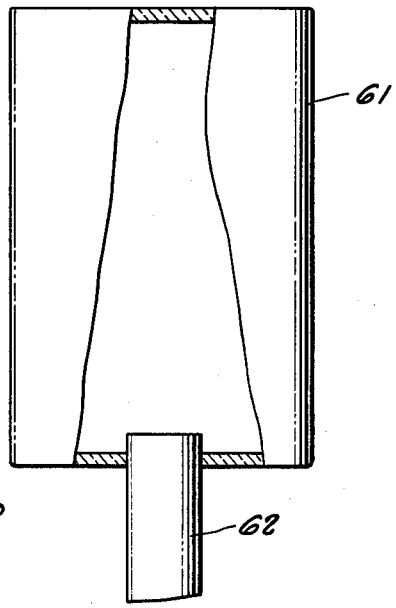
FIG. 8 is a front elevation partly broken away, showing a portion of FIG. 1 on an enlarged scale.

FIG. 8 shows a liquid supply container 61 having a downward projecting discharge pipe 62 which extends to the liquid level in the reservoir 18. As liquid evaporates from the open top reservoir 18, receptacle 32, etc., additional liquid is supplied from this container 61.

Having fully described my invention, it is to be understood that I am not to be limited to the details herein set forth but that my invention is of the full scope of the appended claims.

I claim:

1. In a liquid operated clock, the combination of: a liquid reservoir, means for transferring predetermined amounts of liquid from said reservoir to an elevated receptacle at regular time intervals, a receiver positioned to receive liquid gravitating from said receptacle, a movable member, means for suspending said receiver from said movable member, resilient means acting on said movable member to counterbalance the weight of said receiver and its liquid contents, means connected to said receiver to cause it to empty suddenly upon receiving a series of said predetermined amounts of liquid and thereby to cause movement of said movable member by said resilient means, a clock mechanism driven from an input shaft, and ratchet means driven in response to said movement of said movable member for turning said input shaft intermittently.

2. In a liquid operated clock, the combination of: a rotary arm having a bucket pivoted thereto near the outer end of the arm, means for rotating said arm at a constant speed, a liquid reservoir through which the bucket passes intermittently to cause liquid to enter the bucket, a receptacle positioned above the liquid reservoir into which the bucket discharges liquid, a receiver positioned to receive liquid gravitating from said receptacle, a pivoted member, means for suspending said receiver from said pivoted member, resilient means acting on said pivoted member to counterbalance the weight of said receiver and its liquid contents, means connected to said receiver to cause it to empty suddenly into said reservoir upon receiving a predetermined quantity of liquid, to cause movement of said pivoted member by said resilient means, a clock mechanism driven from an input shaft, and ratchet means driven in response to said movement of said pivoted member for turning said input shaft intermittently.

3. The combination set forth in claim 2 in which a cam element is positioned within said liquid reservoir, and a cam follower is fixed with respect to said bucket, said cam element and cam follower cooperating to hold said bucket in proper position for filling with liquid.

4. In a liquid operated clock, the combination of: a rotary carrier having a plurality of equally spaced buckets pivoted thereto, means for rotating said carrier at a constant speed, a liquid reservoir through which the buckets pass sequentially to cause liquid to enter into the buckets, a receptacle above the level of the liquid reservoir into which the buckets discharge liquid, a receiver positioned to receive liquid gravitating from said receptacle, a pivoted member, means for suspending said receiver from said pivoted member, resilient means acting on said pivoted member to counterbalance the weight of said receiver and its liquid contents, siphon means associated with said receiver to cause it to empty suddenly into said reservoir upon receiving a predetermined quantity of liquid, the diminished weight of said receiver acting to cause said resilient means to move said pivoted member, a clock mechanism driven from an input shaft, and ratchet means driven in response to said movement of said pivoted member for turning said input shaft intermittently.

5. In a liquid operated clock, the combination of: a liquid reservoir, means for transferring predetermined amounts of liquid from said reservoir to an elevated receptacle at regular time intervals, a receiver positioned to receive liquid gravitating from said receptacle, said receiver comprising a chamber open at the top and having a closed bottom wall, the receiver also having a siphon tube fixed thereto and extending through said bottom wall from a position below said bottom wall thereof, the receiver also having a control cylinder open at the bottom and closed at the top and slidably mounted on said siphon tube within said chamber, whereby accumulation of liquid within said control cylinder to the top of the siphon tube causes substantially all of the liquid in the reservoir to be discharged suddenly through said siphon tube, to change the weight of the receiver and contents, a clock mechanism driven from an input shaft, and ratchet means driven in response to change in weight of the receiver and contents for turning said input shaft intermittently.

6. In a liquid operated clock, the combination of: a liquid reservoir, means for intermittently transferring predetermined amounts of liquid from said reservoir to a receiver having a tapered funnel-shaped inlet open at the top, a skirt at the lower end of said inlet defining a closed chamber in the upper portion of said receiver, said receiver having a closed bottom wall, said receiver also having a siphon tube fixed thereto and extending through said bottom wall from a position near the lower end of the skirt to a position below said closed bottom wall, the receiver also having a control cylinder open at the bottom and closed at the top and slidably mounted on said siphon tube, whereby accumulation of liquid within said control cylinder to the top of the siphon tube causes air compression in said closed chamber and causes substantially all of the liquid in the reservoir to be discharged suddenly through said siphon tube, to change the weight of the receiver and contents, a clock mechanism driven from an input shaft, and ratchet means driven in response to change in weight of the receiver and contents for turning said input shaft intermittently.

* * * * *